US012060777B2

(12) United States Patent
Maddux et al.

(10) Patent No.: US 12,060,777 B2
(45) Date of Patent: Aug. 13, 2024

(54) LINER HANGER EXPANSION TOOL WITH ROTATING BALL VALVE

(71) Applicant: Halliburton Energy Services, Inc., Houston, TX (US)

(72) Inventors: Stephen Ross Maddux, Houston, TX (US); Daniel Newton, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/936,482

(22) Filed: Sep. 29, 2022

(65) Prior Publication Data

US 2024/0110466 A1 Apr. 4, 2024

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 2,121,051 A * 6/1938 Ragan ..... E21B 33/1293 166/122
4,583,593 A 4/1986 Zunkel et al.
2004/0216894 A1 11/2004 Maguire
2012/0175132 A1 7/2012 Watson et al.
2014/0054047 A1 2/2014 Zhou

FOREIGN PATENT DOCUMENTS

WO 2015084355 6/2015

OTHER PUBLICATIONS

International Search Report and Written Opinion for International Patent Application No. PCT/US2022/077224 dated Jun. 27, 2023.

* cited by examiner

*Primary Examiner* — D. Andrews
(74) *Attorney, Agent, or Firm* — Scott Richardson; C. Tumey Law Group PLLC

(57) ABSTRACT

A rotating ball valve may be employed in a liner hanger setting tool. A rotating ball member maintains contact with a valve seat throughout the operation of the rotating ball valve, thereby preventing debris from settling on the valve seat and compromising the integrity of a seal through a fluid flow path defined through the setting tool. The rotating ball valve may be actuated by selectively applying fluid pressure to the flow path, or by mechanical manipulation. Once the fluid flow path is closed, a latch may be activated to maintain the rotating ball valve in the closed configuration and a pressure may be applied against the closed rotating ball member. A downhole movement be induced by the applied pressure to drive an expansion cone through an expandable liner hanger, to secure a liner in the wellbore.

20 Claims, 6 Drawing Sheets

LINER HANGER EXPANSION TOOL WITH ROTATING BALL VALVE

BACKGROUND

The present disclosure relates generally to equipment and procedures for subterranean wellbore operations. In particular, embodiments of the disclosure relate to a setting tool for securing an expandable liner hanger in a wellbore.

Expandable liner hangers are generally used to secure a liner within a previously set casing or liner string. These types of liner hangers are typically set by expanding the liner hangers radially outward into gripping and sealing contact with the previously set casing or liner string. To expand the liner hangers, hydraulic pressure may be applied to drive a cone or wedge through the liner hanger, but other methods such as mechanical swaging, explosive expansion, swellable material expansion, etc. may be employed). The expansion procedure may be performed using a setting tool to convey the liner hanger into a wellbore and secure the liner therein. The setting tool may be interconnected between a work string (e.g., a tubular string constructed of drill pipe or other tubular elements) and the liner hanger.

If the liner hanger is expanded using hydraulic pressure, then the setting tool is generally used to control the communication of fluid pressure, and flow to and from various portions of the liner hanger expansion mechanism, and between the work string and the liner. Because the pressure required to drive the cone or wedges is high enough to damage the liner below, to prematurely expand the liner, to inadvertently activate completion equipment below the setting tool, and cause a number of other complications, a ball or flapper valve in the setting tool is often used to isolate the expansion pressure from the liner and other equipment below the setting tool. The ball or flapper must seat correctly to generate a sufficient differential pressure to expand the liner hanger. The ball or flapper may fail to seat due to debris in the wellbore, or there may difficulties in getting a ball to seat in a deviated well where gravity may not be relied upon to deliver the ball to a precise seating location. If the ball or flapper fails to seat, the entire string may need to be returned to the surface, or a secondary hanger may need to be deployed above the primary hanger, each of which result in lost time and expense.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes a rotating ball valve employed in a liner hanger setting tool. The rotating ball valve is a reliable and effective alternative or supplement to a flapper member sealing with a valve seat to close a fluid flow path through the liner hanger setting tool. The rotating ball valve may be actuated by selectively applying fluid pressure to the flow path, or by mechanical manipulation. A latch member may be provided to maintain the rotating ball valve in a closed configuration.

In the following description of the representative embodiments of the disclosure, directional terms, such as "above", "below", "upper", "lower", etc., are used for convenience in referring to the accompanying drawings. In general, "above", "upper", "upward" and similar terms refer to an up-hole direction toward the earth's surface along a wellbore, and "below", "lower", "downward" and similar terms refer to a downhole direction away from the earth's surface along the wellbore.

Figure 1:
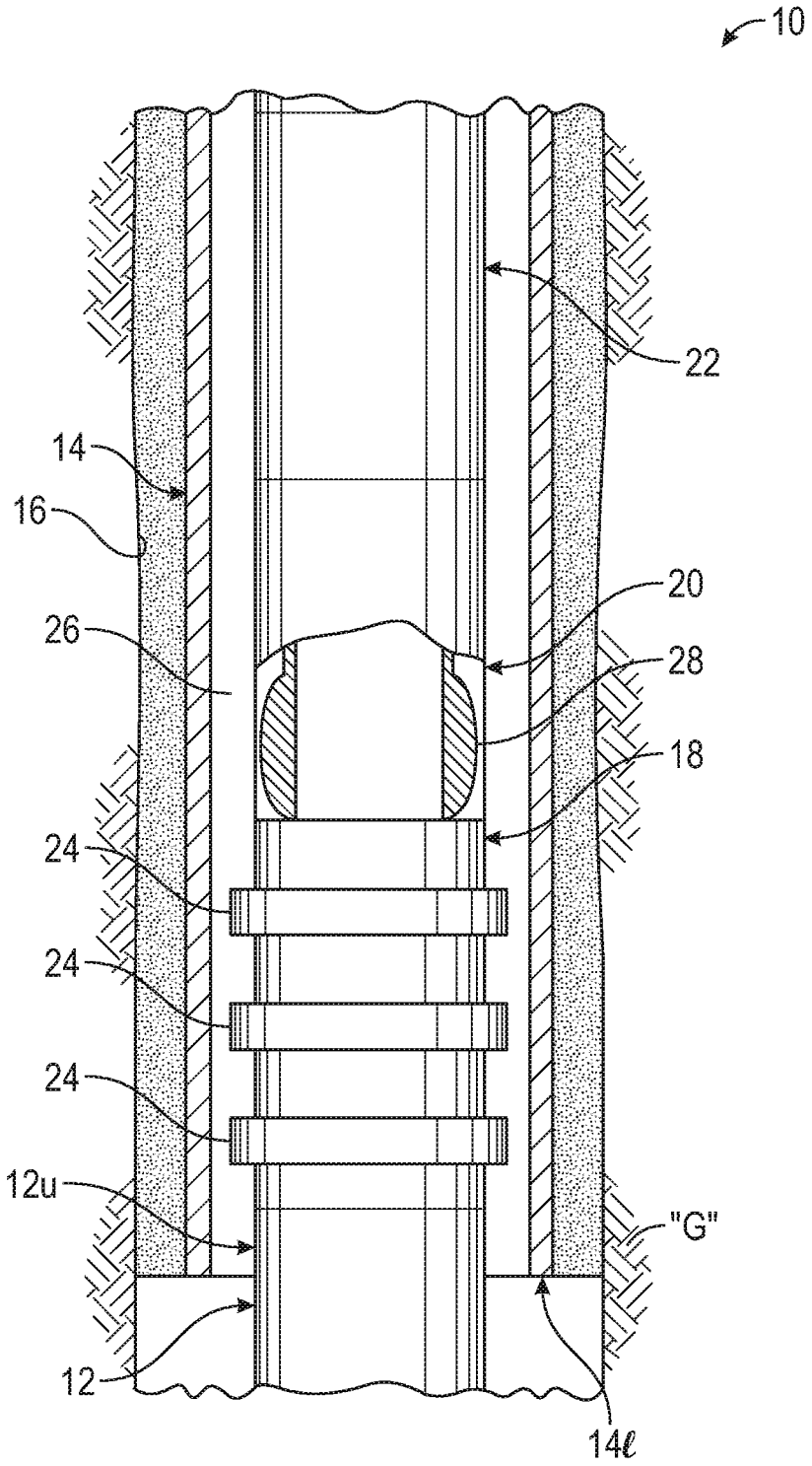
FIG. 1 is a partial, cross-sectional side view of a liner hanger setting system in accordance with the present disclosure including a work string supporting a setting tool, an expandable liner hanger and a liner in a wellbore.

As illustrated in FIG. 1, a liner hanger setting system 10 embodies principles of the present disclosure. System 10 may be employed to install a liner 12 to extend below a casing string 14, which has been installed and cemented within wellbore 16. The liner 12 may be secured to a lower end 14*l* of the casing string 14 to further line the wellbore 16 at greater depths than the casing string 14 extends. As used herein, the terms "liner" and "casing" are used to describe tubular materials which are used to form protective linings in wellbores. Liners and casings may be constructed from any material such as metals, plastics, composites, etc., and may be selectively expanded or unexpanded. Liners and casings may be constructed in a continuous tubular form or may be radially or axially segmented or continuous. It is generally unnecessary for a liner or casing to be cemented in a wellbore. Any type of liner or casing may be used in keeping with the principles of the present invention.

The liner hanger setting system 10 includes an expandable liner hanger 18, which is illustrated as being employed to seal and secure an upper end 12*u* of the liner 12 near the lower end of the casing string 14. In other embodiments, the liner hanger 18 could be used to seal and secure the liner 12 in other configurations without departing from the scope of the disclosure. For example, the upper end 12*u* of the liner 12 may be secured above a window (not shown in FIG. 1) formed through a sidewall of the casing string 14, with the liner 12 extending outwardly through the window into a branch or lateral wellbore. Thus, it will be appreciated that many different configurations and relative positions of the casing string 14 and liner 12 are possible in keeping with the principles of the invention.

A setting tool 20 is connected between the liner hanger 18 and a work string 22 extending to a surface location. The work string 22 is used to convey the setting tool 20, liner hanger 18 and liner 12 into the wellbore 16 and may be employed to conduct fluid pressure and flow, transmit torque, tensile and compressive force, etc. to the setting tool 20. Thus, the setting tool 20 may be employed to facilitate conveyance and installation of the liner 12 and liner hanger 18, in part by using the torque, tensile and compressive forces, fluid pressure and flow, etc. delivered by the work string 22. As described in greater detail below, the setting tool 20 is selectively operable to radially extend external seals 24 provided on the liner hanger 18 to grippingly engage an interior of the casing sting 14 and to seal an annulus 26 defined between the casing string 14 and the work string 22. The setting tool 20 may drive an expansion cone 28 longitudinally in a downward direction through an interior of the liner hanger 18 to outwardly expand or displace the external seals 24. The expansion cone 28 may be driven downward under the influence of a fluid pressure as illustrated in FIG. 2C, for example. As illustrated, the expansion cone 28 has a lower conical surface thereon which engages the interior of the liner hanger 18 to outwardly expand the liner hanger 18. The term "expansion cone" as used herein is intended to encompass equivalent structures which may be known to those skilled in the art as wedges or swages, whether or not those structures include conical surfaces.

As illustrated, the example wellbore 16 extends is generally vertically through geologic formation "G." In other embodiments, a wellbore with any other geometry, e.g., deviated, slanted, curved and/or entirely vertical, may employ the systems and methods described herein without departing from the scope of the disclosure.

Figure 2A:
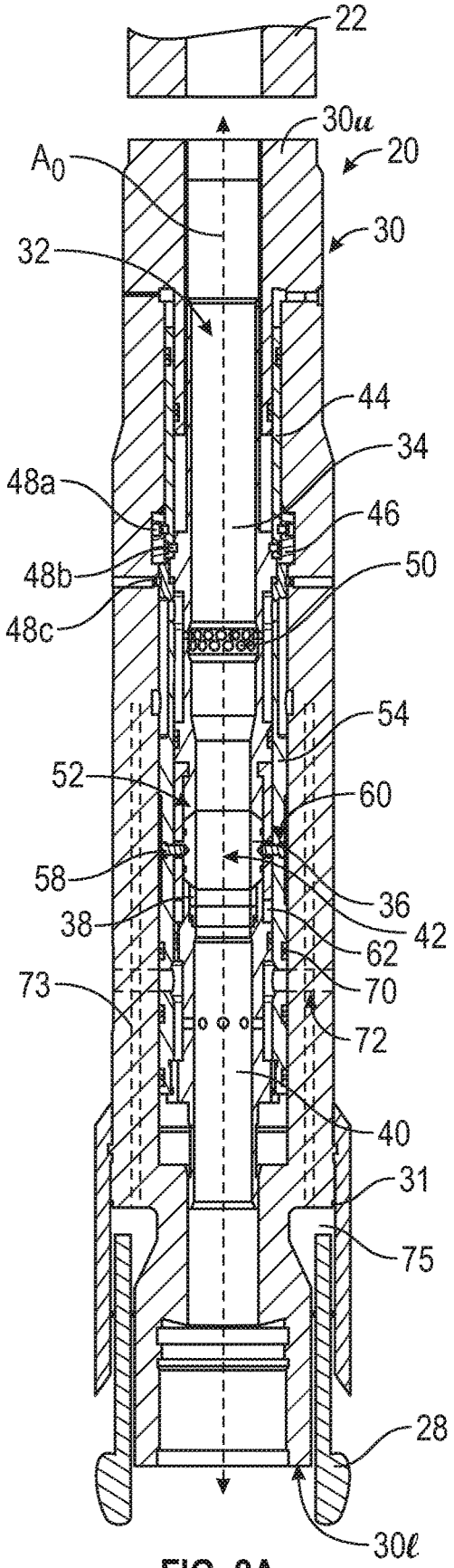
FIGS. 2A through 2C are cross-sectional side views of the setting tool of FIG. 1 in various operational configurations including an initial or run-in configuration (FIG. 2A), an intermediate or sealed configuration (FIG. 2B) and an actuated configuration (FIG. 2C)

Referring now to FIG. 2A, the setting tool 20 is illustrated in an initial configuration in which the setting tool 20 may be run into the wellbore 16 (FIG. 1). The setting tool 20 includes an outer tubular housing 30 defining an upper end 30*u* and a lower end 30*l*. The upper end 30*u* may be coupled to the work string 22 with threads, welds or similar connectors. The lower end 30*l* may be coupled to the liner hanger 18 (FIG. 1) below the setting tool 22 in part by a cone housing 31 sealingly coupled to the outer housing 30. A fluid passageway 32 is defined along a longitudinal axis $A_0$ of the outer housing 30 of the setting tool 22. The fluid passageway 32 generally extends through an upper sleeve member 34, a rotating ball member 36, a valve seat 38 and a lower sleeve member 40. The rotating ball member 36 includes a longitudinal through bore 42 that aligns with the longitudinal axis $A_0$ and forms a portion of the fluid passageway 32 when the setting tool is arranged in the initial configuration of FIG. 2A. As described in greater detail below, the rotating ball member 36 may be selectively rotated to move the through bore 42 out of alignment with the longitudinal axis $A_0$ and thereby seal the fluid passageway 32.

The upper sleeve member 34 is coupled to an upper piston 44 and a retention ring 46 by expendable connectors 48*a*, 48*b*. The expendable connectors 48*a*, 48*b* may be frangible fasteners, shear screws or similar devices that permit selective separation between the components coupled thereby. A first set of expendable connectors 48*a* couples the retention ring 46 to the upper piston 44 and a second set of expendable connectors 48*b* couples the upper piston 44 to the upper sleeve member 34. The retention ring 46 may be fixedly coupled with respect to the outer housing 30 such that the expendable connectors 48*a*, 48*b* retain the upper sleeve member 34 in an initial position with respect to the outer housing 30. In the initial position, a lower end 34*l* of the upper sleeve member 34 engages the rotating ball member 34 such that fluid flow is permitted between the upper sleeve member 34 and the rotating ball member 34. A plurality of radial fluid ports 50 are provided through a sidewall of the upper sleeve member 34 such that a fluid provided through the work string 22 may exit the fluid passageway 32 and apply a fluid pressure, e.g., a sealing fluid pressure, to the upper piston 44 in an up-hole direction. The upper sleeve member 34 is operably coupled to a rotating ball valve 52 including the rotating ball member 36. Specifically, the up-hole movement of the upper sleeve member 34 induces rotational movement of the rotating ball member 36 to seal the fluid passageway 32 as described in greater detail below.

The housing 30 houses a lower piston 54, which is coupled to the housing 30 by a third set of expendable connectors 48*c*. Fluid exiting the fluid passageway 32 through the radial fluid ports 50 may apply a fluid pressure to the lower piston 54 in a downhole direction to release the lower piston 54 from the housing 30 as described in greater detail below. The lower piston 54 is coupled to the rotating ball member 36 by a pair of pivot pins 58 oriented orthogonally with respect to the longitudinal axis $A_0$. The pivot pins 58 each extend through a longitudinal slot 60 defined in a respective guide plate 62 disposed on lateral sides of the rotating ball member 36. The guide plates 62 are fixedly coupled to the upper sleeve member 34 by screws 64 (see FIG. 3A), and longitudinal slot 60 permits longitudinal movement of the upper sleeve member 34 and the guide plates 62 with respect to the pivot pins 58.

The lower piston 54 includes one or more equalization ports 66 defined therethrough in fluid communication with radial fluid ports 68 defined through the lower sleeve member 40. Seal members 70 provided on the lower piston 54 ensure that fluid entering the equalization ports 66 exit through vent ports 72, which are defined in the housing 30 when the setting tool 20 is arranged in the initial configuration. One or more channels 73 are defined through outer housing 30 to direct fluid pressure to the expansion cone 28. The channels 73 are circumferentially offset from the vent ports 72 such that there is no interaction between the channels 73 and the vent ports 72. A pressure chamber 75 is defined at an end of the channels 73 radially between the lower end 30*l* of the outer housing and the cone housing 31. With the rotating ball member 36 in the open configuration, fluid may flow freely through the fluid passageway 32 without an accumulation of fluid pressure in the pressure chamber 75. When the ball member 36 is rotated to close the fluid passageway 32, the channels 73 transmit a fluid pressure from the fluid passageway 32 above the rotating ball member 36, which may be imparted to the expansion cone 28 as described below with reference to FIG. 2C.

Figure 2B:
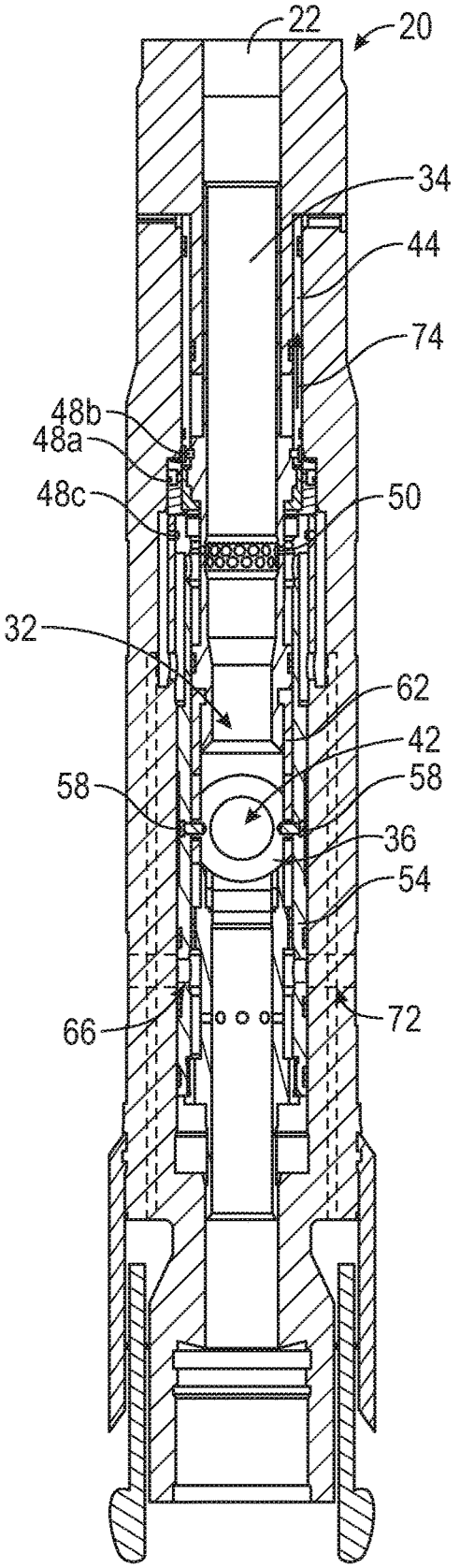
Figure 2C:
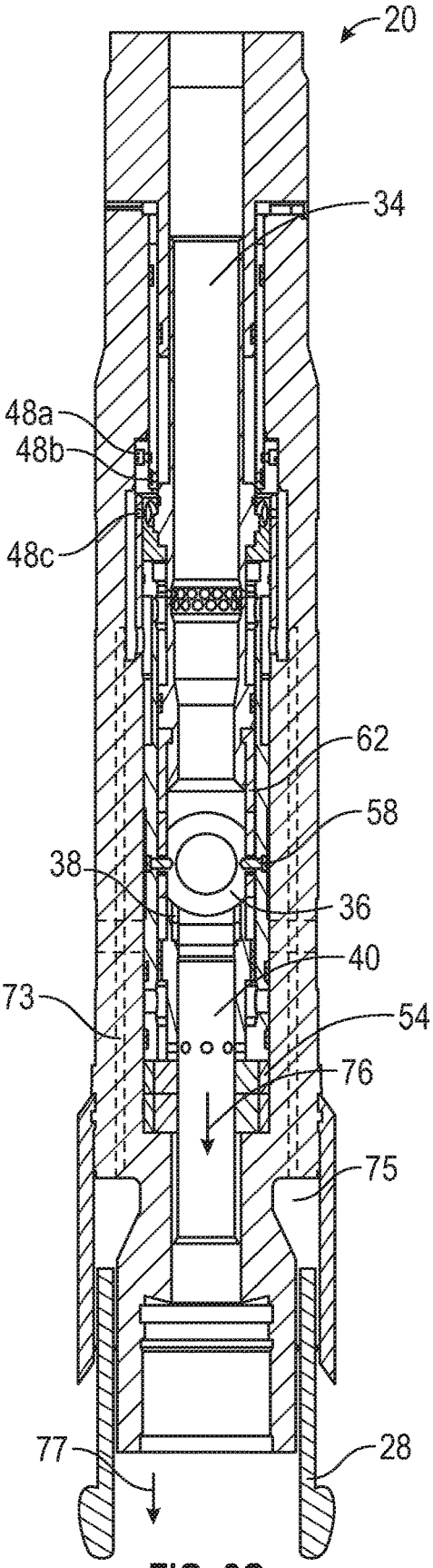

As illustrated in FIG. 2B, the setting tool 20 may be moved to an intermediate or sealed configuration where the through bore 42 of the rotating ball member 36 is rotated to prohibit flow through the fluid passageway 32. To move the setting tool 20 to the intermediate configuration, a working fluid may be pumped down the work string 22 to the fluid passageway 32 of setting tool 20. A portion of the working fluid may pass through the radial ports 50 and apply a fluid pressure to the upper and lower pistons 44, 54. The fluid pressure applied may be sufficient to shear the first set of expendable connectors 48*a*, and insufficient to shear the second and third sets of expendable connectors 48*b*, 48*c*. Thus, the upper piston 44 may be released from its initial position and move up-hole in the direction of arrow 74 under the bias of the fluid pressure. The upper sleeve member 34 and the guide plates 62 move up-hole along with the upper piston 44 in the direction of arrow 74.

The up-hole movement of the upper sleeve member 34 separates the upper sleeve member 34 from the rotating ball member 36, and the up-hole movement of the guide plates 62 induce rotational movement of the rotating ball member 36 about the pivot pins 58 as described in greater detail below with reference to FIGS. 3A-3C. With the rotating ball member 36 in the rotated orientation, the fluid passageway 32 is sealed and the fluid pressure applied to shear the expendable connectors 48*a* may be permitted to dissipate. For example, the fluid pressure above the from the rotating ball member 36 may be bled off through the work string 22 and the fluid pressure below the rotating ball member 36 may be bled off through the vent ports 72.

Referring now to FIG. 2C, the setting tool 20 may be moved to an actuated configuration where the lower sleeve member 40 and the expansion cone 28 are moved in a downhole direction with respect to the outer housing 30 as illustrated by arrow 76. To move the setting tool 20 from the sealed configuration of FIG. 2B to the actuated configuration of FIG. 2C, a working fluid may again be pumped down the work string 22 to the setting tool 20. The working fluid may be pumped against the closed rotating ball member 36 and the lower piston 54 a force in the downhole direction of arrow 76. The force may shear the second and third sets of expendable connectors 48*b*, 48*c* and permit the lower sleeve member 40, the valve seat 38, the rotating ball member 36, the guide plates 62, the pivot pins 58, the upper sleeve member 34 and the lower piston 54 to move downhole together within the outer housing 30. The setting pressure that drives the downward movement of the lower sleeve member 40 is also transmitted through the channels 73 and applied to the pressure chamber 75. The pressure in the pressure chamber 75 drives the expansion cone 28 in the direction of arrows 77 through the liner hanger 18 (FIG. 1) to radially extend external seals 24 (FIG. 1) into sealing contact with the casing string 14 (FIG. 1). The setting pressure applied to drive the expansion cone 28 may be greater than the sealing pressure applied to rotate the rotating ball member 36.

Figure 3A:
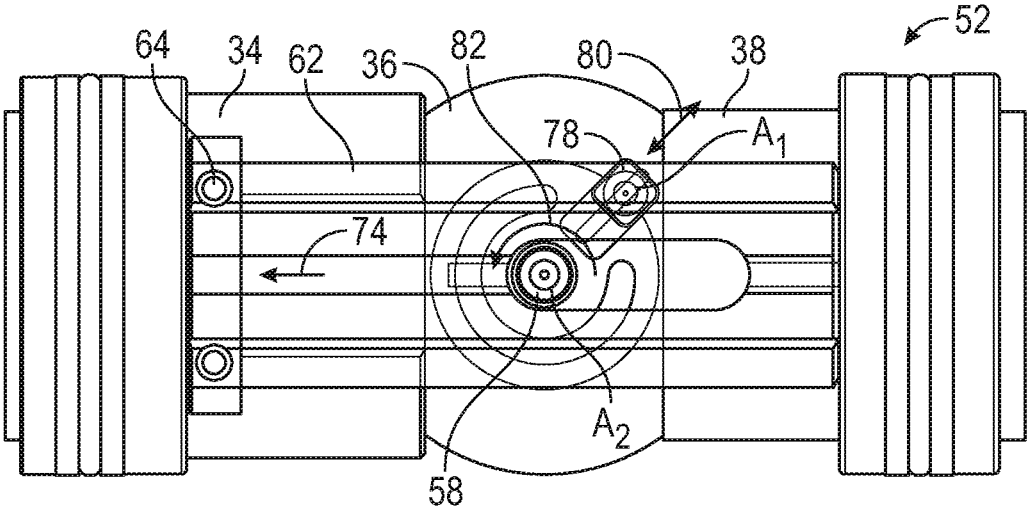
FIGS. 3A through 3C are cross-sectional top views of a rotating ball valve of the setting tool when the setting tool is in the run-in configuration (FIG. 3A), the sealed configuration (FIG. 3C) and an intermediate configuration (FIG. 3B) between the run-in and sealed configurations.

Referring now to FIG. 3A, the rotating ball valve 52 is illustrated in an open configuration in which the rotating ball valve 52 may be arranged when the setting tool 20 is arranged in the initial configuration of FIG. 2A. The upper sleeve member 34 engages the rotating ball member 36 and the rotating ball member 36 engages the valve seat 38. Screws 64 fixedly couple the guide plates 62 to the upper sleeve member 34 such that the guide plates 62 move in the up-hole direction of arrow 74 along with the upper sleeve member 34. A rotation pin 78 is provided, which is laterally offset from the pivot pins 58 and generally parallel to the pivot pins 58. The rotation pin 78 is coupled between the guide plate 62 and the rotating ball member 36 such that the rotation pin 78 is free to rotate about an axis $A_1$ through the rotation pin and free to slide in a radial direction with respect to the rotating ball member 36 as illustrated by arrows 80. The position of the rotation pin 78 with respect to the guide plate 62 is fixed such that movement of the guide plate 62 in the direction of arrow 74 induces rotational movement of the rotating ball member 36 in the direction of arrows 82 about an axis $A_2$ defined through the pivot pins 58.

Figure 3B:
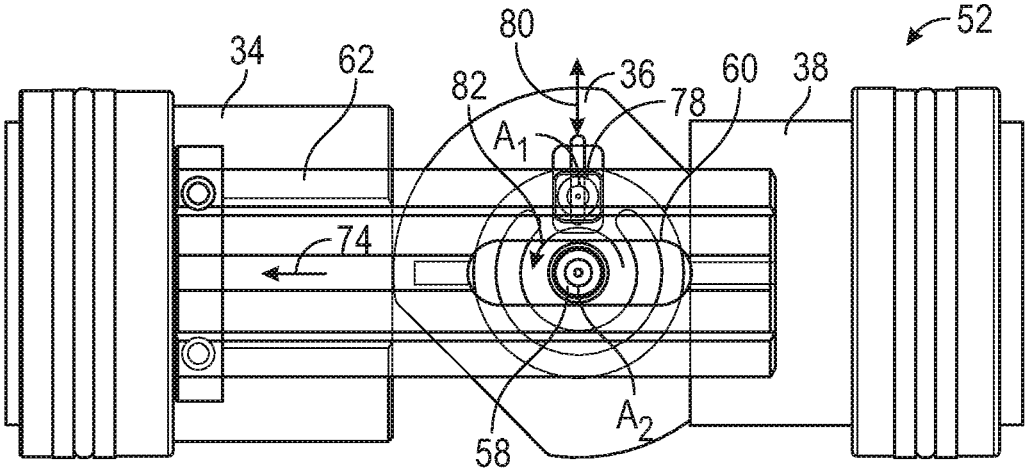
Figure 3C:
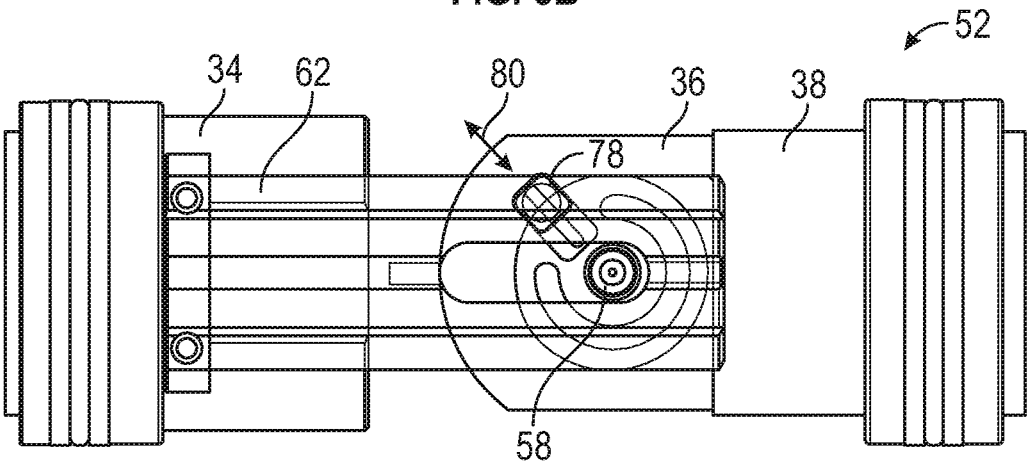

As illustrated in FIG. 3B, as upper sleeve member 34 moves in the up-hole direction of arrow 74 and separates from the rotating ball member 36, longitudinal slot 60 in the guide plate 62 provides clearance for the pivot pin 58. The rotation pin 78 transforms the linear motion of the guide plate 62 into rotational motion of the rotating ball member 36. The rotation pin 78 slides in the direction of arrows 80 and rotates about the axis $A_1$ until the rotating ball member 36 reaches the closed orientation of FIG. 3C. The rotating ball member 36 maintains contact with the valve seat 38 in the open configuration of FIG. 3A, as the rotating ball member 36 rotates through the intermediate configuration of 3B and the rotating ball member 36 reaches the closed configuration of FIG. 3C. Thus, the rotating ball member 36 serves to maintain the valve seat 38 free of debris that could otherwise inhibit a full closure of the valve 52.

Figure 4A:
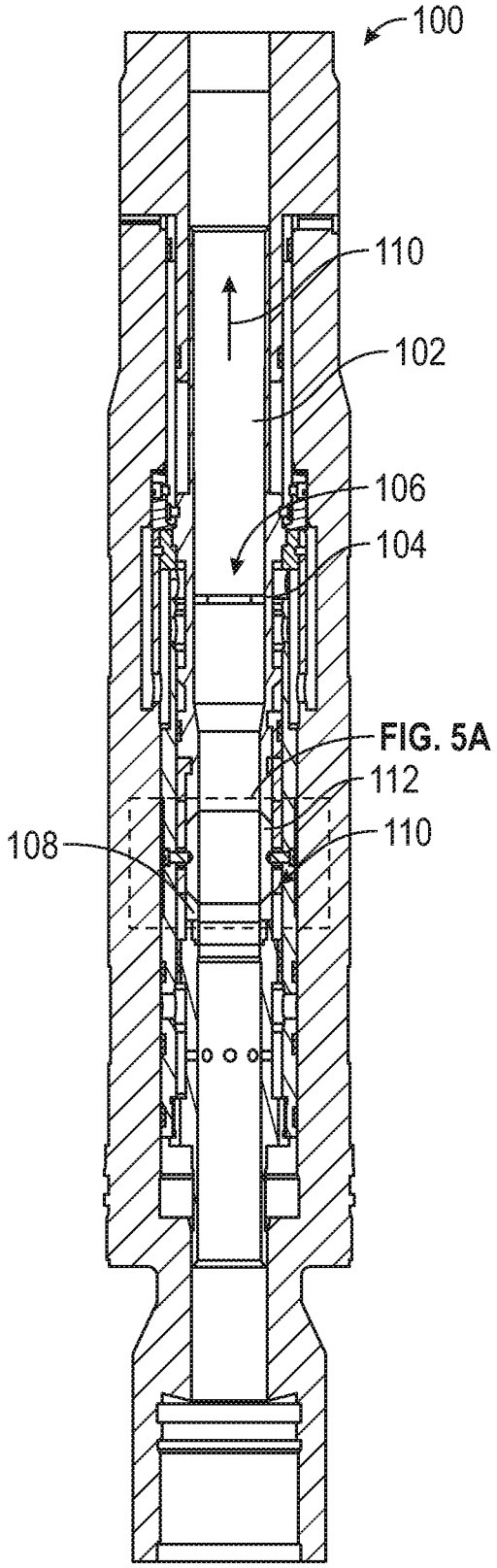
FIGS. 4A and 4B are cross-sectional side views of an alternate embodiment of a setting tool including an internal shoulder for mechanically moving the setting tool from an initial or run-in configuration (FIG. 4A) and an intermediate or sealed configuration (FIG. 4B) and a latch mechanism for maintaining a rotating ball member in a closed configuration.
Figure 4B:
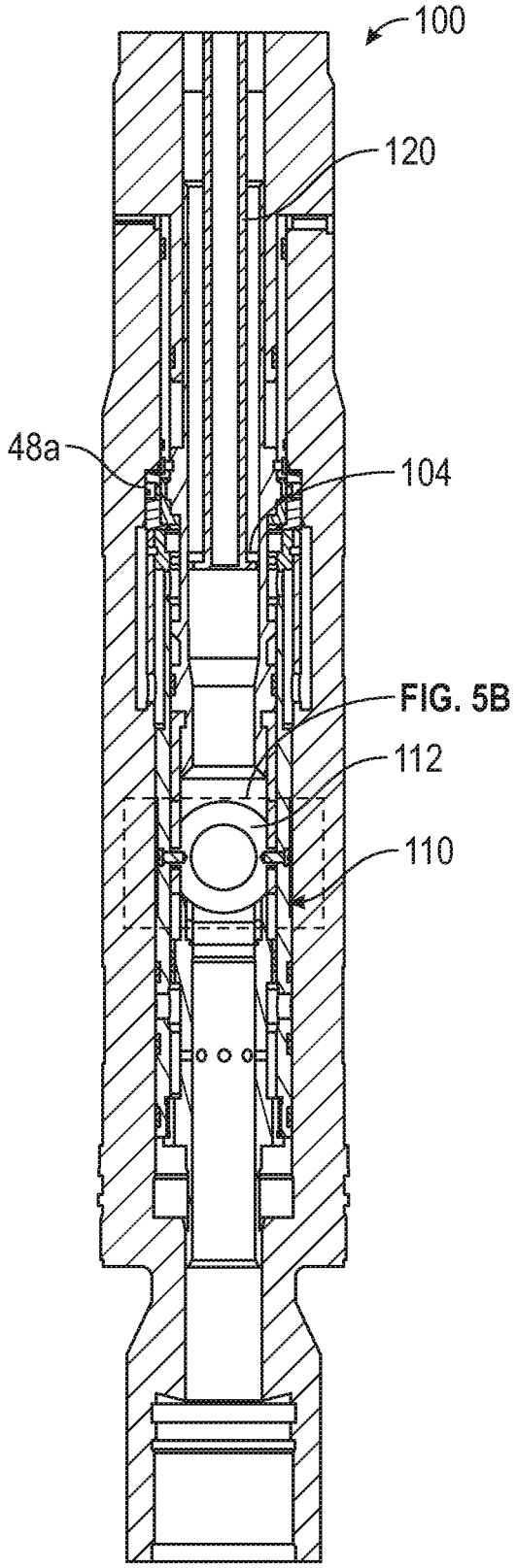
Figure 5A:
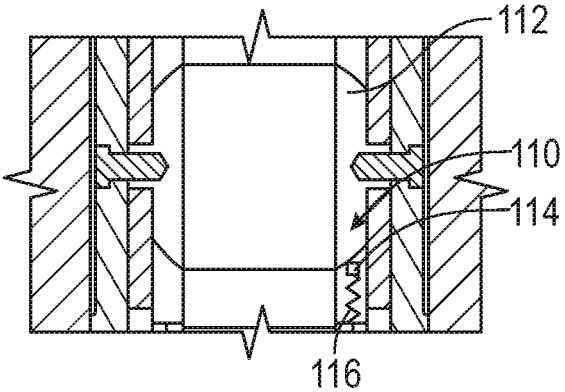
FIGS. 5A and 5B are enlarged views of the areas of interest identified in FIGS. 4A and 4B, respectively, illustrating the latch mechanism in unlatched and latched configurations.

Referring now to FIG. 4A, an alternate embodiment of a setting tool 100 is illustrated, which is arranged for operation by mechanical intervention. The setting tool 100 includes an upper sleeve member 102 including an internal shoulder 104 extending radially inward into a fluid passageway 106. The internal shoulder 104 may be engaged to move the upper sleeve member 102 in the up-hole direction of arrow 110. A valve seat 108 includes a latch mechanism 110 (see also, FIG. 5A), which may be operated to secure a rotating ball member 112 in a closed configuration as illustrated in FIG. 4B. The latch mechanism 110 may include a latch member 114 that is biased toward the rotating ball member 112 by a spring 116 or another biasing member.

Figure 5B:
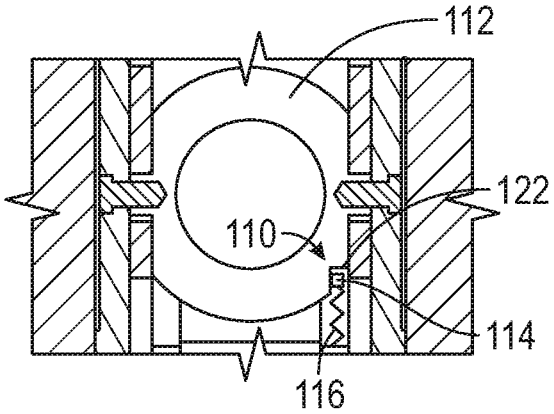

As illustrated in FIG. 4B, the setting tool 100 may be moved to an intermediate or sealed configuration by engaging an intervention tool 120 with the internal shoulder 104 of the upper sleeve member 102. An up-hole force may be applied to the intervention tool 120 from a surface location to shear the first set of expendable connectors 48*a* and draw the upper sleeve member 102 in an up-hole direction. The up-hole movement of the upper sleeve member 102 induces rotational movement of the rotating ball member 112, in a manner similar to the process described above with reference to FIGS. 3A through 3C. The rotating ball member 112 includes a slot 122 arranged to receive the latch member 114 under the bias of the spring 116 when the rotating ball member reaches the closed configuration of FIG. 4B (see also FIG. 5B). The latch member 114 extends into the slot 122 to maintain the rotating ball member 112 in the closed configuration. The internal shoulder 104 and the latch mechanism 110 may be incorporated individually or in combination into the embodiments of FIGS. 2A through 2C without departing from the scope of the disclosure.

In other alternate embodiments (not shown), a rotating ball member may be selectively rotated without the direct application of hydraulic pressure at the surface (such as in the embodiment of FIGS. 2A through 2C) and without the direct application of mechanical force at the surface (such as in the embodiments of FIGS. 4A and 4B). A downhole actuator, such as an electric motor or hydraulic piston, may be provided that is operably coupled to the rotating ball member. The downhole actuator may be responsive to a control signal, such as electromagnetic waves or acoustic waves, which may be transmitted from the surface or from a downhole controller. A downhole controller may include an electronics package with at least one sensor for detecting conditions of the downhole environment, such as pressure, temperature, vibration, circulation rate, time, etc. The at least one sensor may be operably connected to a processor of the electronics package that may determine whether the detected conditions fall within a range predetermined to indicate that the rotating ball member should be rotated. The processor may be operably coupled to a transmitter, which may be instructed to generate the control signal when the processor determines that the downhole actuator should be activated to initiate rotation of the rotating ball member.

Figure 6:
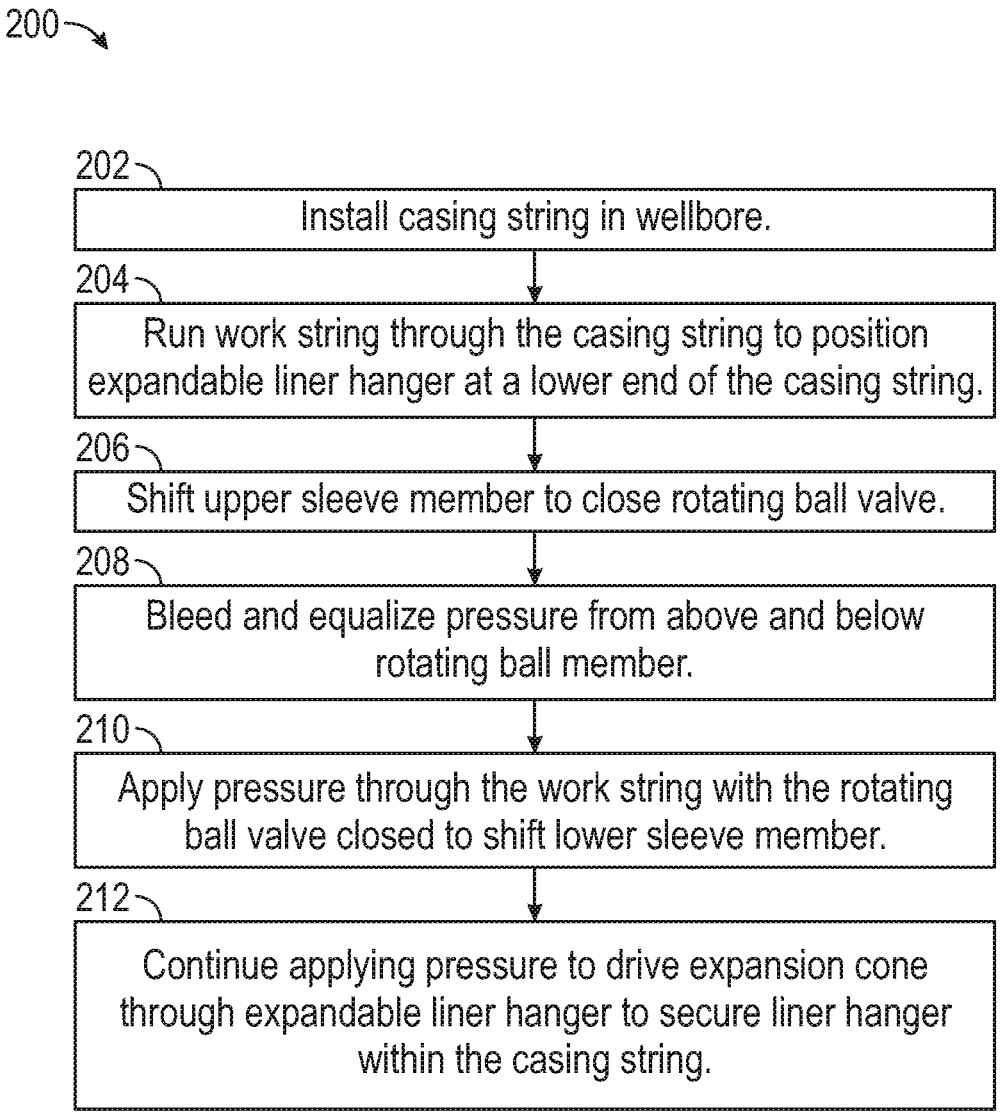
FIG. 6 is a flowchart illustrating a procedure for operating the check valves of the liner hanger setting tool in an example wellbore operation.

Referring now to FIG. 6, and with reference to FIGS. 1 through 4B, a procedure 200 is described for employing a setting tool 20, 100 to install a liner hanger 18. Initially at step 202, a casing string 14 may optionally be installed and cemented in a wellbore 16. A work string 22 including a setting tool 20, expandable liner hanger 18 and liner 12 is then lowered through the casing string to position the expandable liner hanger 18 adjacent a lower end 14*l* of the casing string 14 (step 204).

At step 206, the upper sleeve member 34, 102 is shifted to rotate the rotating ball member 36, 112. The upper sleeve member 34 may be shifted by applying a pressure through the work string 22 to drive an upper piston 44 in an up-hole direction, and/or the upper sleeve member 102 may be mechanically shifted by an intervention tool 120. The shifting of the upper sleeve member 34, 102 rotates the rotating ball member 36, 112 by longitudinally shifting a rotating pin that is laterally offset from the pivot pins 58 about which the rotating ball member 36, 112 rotates.

At step 208, any fluid pressure accumulated above and below the rotating ball member 36, 112 may be bled off through the work string 22 and/or vent ports 72. With the pressure above and below the rotating ball member 36, 112 equalized, a working fluid may be pumped through the work string to apply a pressure to the closed rotating ball member 36, 112 to shift a lower sleeve member 40 (step 210). The pressure applied to the closed rotating ball member 36, 112 may be passed through the channels 73 and maintained to drive the expansion cone 28 through the expandable liner hanger 18 to secure the expandable liner hanger 18 within the casing string 14 (step 212).

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According one aspect, the present disclosure is directed to a setting tool for a liner hanger. The setting tool includes an outer tubular setting tool housing defining a longitudinal axis and a fluid passageway extending along the longitudinal axis. A valve seat is defined within the housing and a rotating ball member is engaged with the valve seat. The rotating ball member is rotatable between an open configuration in which fluid flow through the fluid passageway is permitted and a closed configuration in which fluid flow through the fluid passageway is obstructed by the rotating ball member. An expansion cone is operably coupled to the ball member to move longitudinally in response to a setting fluid pressure applied to the rotating ball member through the fluid passageway.

In one or more embodiments, the setting tool may further include a piston within the fluid passageway, the piston operably coupled to the rotating ball member to move the rotating ball member from the open configuration to the closed configuration in response to a sealing fluid pressure applied to the piston through the fluid passageway. The setting tool may further include a first set of expendable connectors coupled between the piston and the housing to maintain the position of the piston within the housing until the sealing fluid pressure is applied to the piston. The setting tool may further include a second set of expendable connectors coupled between the expansion cone and the housing to maintain the position of the expansion cone within the housing until the setting fluid pressure is applied to the rotating ball member, wherein the setting fluid pressure is greater than the sealing fluid pressure. The setting tool may further include a vent port extending radially through the housing and fluidly coupled to the fluid passageway at a location downhole of the rotating ball member to permit the sealing fluid pressure to be bled when the rotating ball member is in the closed configuration.

In some embodiments, the setting tool further includes a rotation pin coupled between the piston and the rotating ball member, the rotation pin coupled to the piston to move longitudinally along with the piston and coupled to the rotating ball laterally offset from a pivot axis of the rotating ball member. In one or more embodiments, the setting tool further includes a latch member selectively engageable with the rotating ball member to maintain the rotating ball member in the closed configuration.

In one or more embodiments, the setting tool further includes an upper sleeve member engaged with the rotating ball member when the rotating ball member is in the open configuration and separable from the rotating ball member to rotate the rotating ball member to the closed configuration. The upper sleeve member may include an internal shoulder engageable by an intervention tool to separate the upper sleeve member from the rotating ball member. The upper sleeve member may be operably coupled to the rotating ball member such that the separation of the upper sleeve member from the rotating ball member induces rotational motion in the rotating ball member from the open configuration to the closed configuration.

According to another aspect, the disclosure is directed to a liner hanger setting system. The system includes a liner, an expandable liner hanger coupled to an upper end of the liner and a setting tool housing coupled to an upper end of the expandable liner hanger. The housing defines a longitudinal axis and a fluid passageway extending along the longitudinal axis. A valve seat is defined within housing and a rotating ball member is engaged with the valve seat. The rotating ball member is rotatable between an open configuration in which fluid flow through the fluid passageway is permitted and a closed configuration in which fluid flow through the fluid passageway is obstructed by the rotating ball member. An expansion cone is operably coupled to the ball member to move longitudinally through the expandable liner hanger in response to a setting fluid pressure applied to the rotating ball member through the fluid passageway.

In some embodiments, the system further includes an upper sleeve member operably coupled to the rotating ball member such that the separation of the upper sleeve member from the rotating ball member induces rotational motion in the rotating ball member from the open configuration to the closed configuration. In some embodiments, the system may further include a piston coupled to the upper sleeve member, the piston responsive to a sealing fluid pressure applied through the fluid passageway to induce the separation of the sleeve member from the rotating ball member. In some other embodiments, the system may further include an intervention tool engaged with an internal shoulder of the upper sleeve member such that an up-hole force applied to the intervention tool from a surface location is transmitted to the upper sleeve member.

In one or more embodiments, the system further includes a first set of expendable connectors coupled between the upper sleeve member and the housing to releasably maintain the position of the upper sleeve member within the housing. The system may further include a second set of expendable connectors coupled between the expansion cone and the housing to releasably maintain the position of the expansion cone within the housing.

In some embodiments, the system further includes a work string coupled to an upper end of the housing, the housing fluidly coupled to the fluid passageway of the setting tool housing. In one or more embodiments, the expansion cone includes a lower conical surface thereon which engages an interior of the liner hanger to outwardly expand the liner hanger in response to longitudinal movement of the expansion cone through the liner hanger.

According to another aspect, the disclosure is directed to a method for setting a liner hanger in a casing string installed in a subterranean wellbore. The method includes (a) running a work string into the wellbore, the work string including the liner hanger and a setting tool, (b) rotating a ball member within a fluid passageway defined through the setting tool to close the fluid passageway, (c) flowing a working fluid through the work string to apply a setting pressure against the ball member, (d) moving an expansion cone through the liner hanger in response to the pressure applied against the ball member and (e) radially extending the liner hanger into sealing contact with the casing string in response to moving the expansion cone through the liner hanger.

In some embodiments, the method further includes applying a sealing pressure through the fluid passageway to longitudinally displace a piston operably coupled to the ball member to rotate the ball member in response to longitudinal movement of the piston, the sealing pressure less than the setting pressure. The method may further include bleeding the sealing fluid pressure from below the ball member prior to applying the setting pressure against the ball member.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A setting tool for a liner hanger, the setting tool comprising:

an outer tubular setting tool housing defining a longitudinal axis and a fluid passageway extending along the longitudinal axis;

a valve seat defined within the housing;

a guide plate that comprises a longitudinal slot extending along the longitudinal axis and configured to translate along the longitudinal axis;

a rotating ball member engaged with the valve seat and configured to rotate between:

an open configuration in which fluid flow through the fluid passageway is permitted; and a closed configuration in which fluid flow through the fluid passageway is obstructed by the rotating ball member;

a pivot pin fixed to the rotating ball member and disposed in the longitudinal slot; and an expansion cone operably coupled to the rotating ball member to move longitudinally in response to a setting fluid pressure applied to the rotating ball member through the fluid passageway.

2. The setting tool according to claim 1, further comprising a piston within the fluid passageway, the piston operably coupled to the rotating ball member to move the rotating ball member from the open configuration to the closed configuration in response to a sealing fluid pressure applied to the piston through the fluid passageway.

3. The setting tool according to claim 2, further comprising a first set of expendable connectors coupled between the piston and the housing to maintain a position of the piston within the housing until the sealing fluid pressure is applied to the piston.

4. The setting tool according to claim 3, further comprising a second set of expendable connectors coupled between the expansion cone and the housing to maintain the position of the expansion cone within the housing until the setting fluid pressure is applied to the rotating ball member, wherein the setting fluid pressure is greater than the sealing fluid pressure.

5. The setting tool according to claim 2, further comprising a vent port extending radially through the housing and fluidly coupled to the fluid passageway at a location downhole of the rotating ball member to permit the sealing fluid pressure to be bled when the rotating ball member is in the closed configuration.

6. The setting tool according to claim 2, further comprising a rotation pin coupled between the piston and the rotating ball member, the rotation pin coupled to the piston to move longitudinally along with the piston and coupled to the rotating ball member laterally offset from a pivot axis of the rotating ball member.

7. The setting tool according to claim 1, further comprising a latch member selectively engageable with the rotating ball member to maintain the rotating ball member in the closed configuration.

8. The setting tool according to claim 1, further comprising an upper sleeve member engaged with the rotating ball member when the rotating ball member is in the open configuration and separable from the rotating ball member to rotate the rotating ball member to the closed configuration.

9. The setting tool according to claim 8, wherein the upper sleeve member includes an internal shoulder engageable by an intervention tool to separate the upper sleeve member from the rotating ball member, the upper sleeve member operably coupled to the rotating ball member such that the separation of the upper sleeve member from the rotating ball member induces rotational motion in the rotating ball member from the open configuration to the closed configuration.

10. A liner hanger setting system, comprising:

a liner;

an expandable liner hanger coupled to an upper end of the liner;

a setting tool housing coupled to an upper end of the expandable liner hanger, the housing defining a longitudinal axis and a fluid passageway extending along the longitudinal axis;

a valve seat defined within the setting tool housing;

a guide plate that comprises a longitudinal slot extending along the longitudinal axis and configured to translate along the longitudinal axis;

a rotating ball member engaged with the valve seat and rotatable between:

an open configuration in which fluid flow through the fluid passageway is permitted; and a closed configuration in which fluid flow through the fluid passageway is obstructed by the rotating ball member;

a pivot pin fixed to the rotating ball member and disposed in the longitudinal slot; and an expansion cone operably coupled to the rotating ball member to move longitudinally through the expandable liner hanger in response to a setting fluid pressure applied to the rotating ball member through the fluid passageway.

11. The system according to claim 10, further comprising an upper sleeve member operably coupled to the rotating ball member such that a separation of the upper sleeve member from the rotating ball member induces rotational motion in the rotating ball member from the open configuration to the closed configuration.

12. The system according to claim 11, further comprising a piston coupled to the upper sleeve member, the piston responsive to a sealing fluid pressure applied through the fluid passageway to induce the separation of the sleeve member from the rotating ball member.

13. The system according to claim 11, further comprising an intervention tool engaged with an internal shoulder of the upper sleeve member such that an up-hole force applied to the intervention tool from a surface location is transmitted to the upper sleeve member.

14. The system according to claim 11, further comprising a first set of expendable connectors coupled between the upper sleeve member and the housing to releasably maintain a position of the upper sleeve member within the housing.

15. The system according to claim 14, further comprising a second set of expendable connectors coupled between the expansion cone and the housing to releasably maintain a position of the expansion cone within the housing.

16. The system according to claim 10, further comprising a work string coupled to an upper end of the setting tool housing.

17. The system according to claim 10, wherein the expansion cone includes a lower conical surface thereon which engages an interior of the liner to outwardly expand the liner in response to longitudinal movement of the expansion cone through the liner.

18. A method for setting a liner hanger in a casing string installed in a wellbore, the method comprising:

running a work string into the wellbore, the work string including the liner hanger and a setting tool;

rotating a ball member within a fluid passageway defined through the setting tool to close the fluid passageway;

flowing a working fluid through the work string to apply a setting pressure against the ball member;

moving an expansion cone through the liner hanger in response to the setting pressure applied against the ball member; and radially extending the liner hanger into sealing contact with the casing string in response to moving the expansion cone through the liner hanger, wherein the liner hanger comprises:

a guide plate that comprises a longitudinal slot extending along a longitudinal axis and configured to translate along the longitudinal axis; and a pivot pin fixed to the rotating ball member and disposed in the longitudinal slot.

19. The method according to claim 18, further comprising applying a sealing pressure through the fluid passageway to longitudinally displace a piston operably coupled to the ball member to rotate the ball member in response to longitudinal movement of the piston, the sealing pressure less than the setting pressure.

20. The method according to claim 19, further comprising bleeding the sealing pressure from below the ball member prior to applying the setting pressure against the ball member.

* * * * *